United States Patent [19]

Potter

[11] 4,295,281

[45] Oct. 20, 1981

[54] DRYING SOLID MATERIALS

[75] Inventor: Owen E. Potter, Camberwell, Australia

[73] Assignee: Monash University, Victoria, Australia

[21] Appl. No.: 974,245

[22] Filed: Dec. 29, 1978

[30] Foreign Application Priority Data

Feb. 10, 1978 [AU] Australia ..... PD3341

[51] Int. Cl.[3] ..... F26B 3/08; F26B 3/10; F26B 3/00; F26B 5/00

[52] U.S. Cl. ..... 34/10; 34/32; 34/36; 34/37

[58] Field of Search ..... 34/10, 32, 36, 37, 57 R, 34/57 A

[56] References Cited

U.S. PATENT DOCUMENTS

| | | | |
|---|---|---|---|
| 2,629,938 | 3/1953 | Montgomery | 34/10 |
| 3,654,705 | 4/1972 | Smith et al. | 34/10 |
| 3,751,214 | 8/1973 | Wenzel et al. | 34/10 |
| 3,800,427 | 4/1974 | Kemmetmueller | 34/10 |
| 4,043,049 | 8/1977 | Hedstrom | 34/10 |
| 4,157,245 | 6/1979 | Mitchell et al. | 34/10 |

*Primary Examiner*—John J. Camby
*Attorney, Agent, or Firm*—Larson and Taylor

[57] ABSTRACT

The invention relates to a method of drying a solid material containing less than 95% by weight of a vaporizable material which comprises establishing a fluidized bed containing the solid material, introducing fluidizing medium, heating the fluidized bed indirectly, feeding the solid material to be dried to the fluidized bed and removing dried solid material therefrom, and removing vapor product from the fluidized bed. In accordance with the present invention the fluidizing medium is the vaporizable material in vapor form and vapor product comprising the vaporizable material substantially uncontaminated by other gases is removed from the fluidized bed for further use. By producing a vapor product substantially uncontaminated by other gases, the invention enables economic recovery of the vaporizable material per se, as well as the latent heat thereof, which is of particular value when the vapor product is steam.

13 Claims, 4 Drawing Figures

17
18
10
12
36
COLD WATER
42
19
30
44
20
CONDENSATE
TOP FLUID BED
40
32
38
16
34
14
24
22
26
28

STEAM
CONDENSATE
REHEAT STEAM
HP TURBINE
IP TURBINE
BOILER
70
72
74
FEED WATER HEATER
86
LP TURBINE
80
STEAM GENERATOR
CONDENSER
82
78
DIRTY CONDENSATE
76
FEED WATER HEATER
FRESH CLEAN FEED WATER 68° F.
DIRTY CONDENSATE
84

DRYING SOLID MATERIALS

CROSS REFERENCE TO RELATED APPLICATIONS

Co-filed application Ser. No. 974,244 filed Dec. 29, 1978 based on Australian application No. PD 3342 filed Feb. 10, 1978, and co-filed application Ser. No. 974,246 filed Dec. 29, 1978 now U.S. Pat. No. 4,245,395 based on Australian application No. PD 3344 filed Feb. 10, 1978, the disclosures of which are incorporated herein by reference.

The present invention relates to a method of drying solid material containing vapourisable material such as drying of particulate or lump material containing water or removal of solvent from particulate or lump material.

Combustion of coal for power generation is adversely affected by high moisture content in the coal. This is particularly so with brown coal which often contains two pounds water per pound of dry coal and therefore presents special problems in combustion. It is possible to increase the efficiency of a boiler substantially by burning dry coal instead of raw coal.

It is known to dry brown coal prior to combustion using hot combustion gases or air which has been heated by steam or hot gases and drawing or blowing the gas over or through the brown coal in particulate form. However, this method of drying offers no advantages compared to burning raw coal since the steam driven off is admixed with gas. The gas/steam mixture is simply vented to the atmosphere and its energy content lost since it is not economical to attempt to recover or use the energy. Also, this method of drying is hazardous.

In U.S. Pat. No. 3,800,427 there is described a method for drying coal in which coal particles are fed into a drying chamber where the coal is suspended in a fluidized bed while being dried in an atmosphere of steam which is at a temperature too low to release oxygen but high enough to extract sulphur from the coal particles. The temperature of the atmosphere in the fluidized bed where the drying of the coal takes place is regulated with heating coils which directly contact the coal particles while the latter are suspended in the fluidized bed, so that further drying is achieved by direct contact between the coal particles and the heating coils. Gas extracted from the dryer is treated to have water condensed therefrom and to extract sulphur therefrom. In addition, pellets of calcium oxide and/or magnesium oxide are delivered to the fluidized bed together with coal particles for further extracting sulphur from the atmosphere in the fluidized bed, these pellets also being subsequently treated, as by roasting, to extract sulphur therefrom.

In the method described in U.S. Pat. No. 3,800,427 steam is produced in a heat exchanger fed with feed liquid water together with steam from the heater, by heat derived from coke oven quench gas. The steam so produced is partially supplied to a plenum at the bottom of the fluidized bed and partially to the heating coils. The steam within the coils is superheated as is evidenced by the fact that steam entering the coils is at a temperature of 250°-450° C. and that it is steam which discharges back to the inlet pipe. This means that the steam will not condense within the coils. The result of this is that there will be a very low coefficient of heat transfer between the coils and the coal particles in the fluidized bed.

In U.S. Pat. No. 3,654,705 there is described method and apparatus for drying a feed stream having a high liquid content, such as organic wastes containing 95% or more of water. In this invention, a plurality of conduits are immersed in a fluidized bed of solid particles. The feed stream is introduced into the fluidized bed of solid particles and a heating fluid is channelled through the conduits to supply heat for vapourising volatiles contained in the feed stream. Solid particles of dried feed material and volatiles are removed together from an upper region of the apparatus. Subsequently, the volatiles and dried feed solids are separated from one another. A portion of the volatiles is returned to a plenum below the fluidized bed and the remainder of the volatiles is compressed, cooled to its saturation temperature and recycled through the heating conduits. The degree of compression is very small being of the order of 29 p.s.i.a. which would give a very small temperature gradient between the heating conduits and the fluidized bed. Such a small temperature gradient would not be effective for drying of materials containing less than 95% water, that is the required drying vessel would be unduly large. Furthermore, solid feed particulates are removed overhead and not from the dense bed of particles.

Also, in U.S. Pat. No. 3,654,705, the fluidized bed particles are silica, alumina, silicon carbide, limestone, glass beads or ceramic particles. In the present invention particles are dried in a bed of particles which have already been dried. However, lumps are dried in a bed of material chosen to have a density in which the lumps to be dried will not be relatively heavy enough to sink to the bottom or so relatively light as to float on the surface.

The present invention relates to a method in which particulate or lump materials are dried and vapour resulting from the drying is usable for further heating, drying or power generation purposes. The drying system of the present invention is much less hazardous than some known drying systems.

In accordance with the present invention there is provided a method of drying a solid material containing less than 95%, preferably less than 75%, by weight of a vapourisable material which comprises establishing a fluidized bed containing the solid material in which the fluidizing medium is the vapourisable material in vapour form and in which the fluidized bed is heated indirectly, feeding the solid material to be dried to the fluidized bed and removing the dried solid material from the fluidized bed, such that vapourisable material is removed from the solid material for further use.

In the method of the present invention the solid material is in particulate or lump form. When the solid material is in particulate form it preferably forms the fluidized bed without the presence of any other fluidized material. When the solid material is in lump form the fluidized bed contains another material which is fluidized and the lump material is fed into the other fluidized material.

In the present invention the indirect heating of the fluidized bed may be achieved by heated jackets or tubes located in the bed. The tubes may be horizontal or vertical or in any convenient position. The indirect heating means may be heated by any convenient means such as electrically, by hot gases or by vapour which may have been obtained from the fluidized bed and recycled. The fluidized bed may be operated at a temperature such that the vapour therein is superheated although this depends on the condition of the material being dried. For example, superheat in steam when drying brown coal can only be achieved when the coal is sufficiently dry to exert less than the vapour pressure of water. The upper limit of temperature is set by the decomposition temperature of the solid material or by the availability of heating medium for the indirect heating. The fluidized bed may be operated under pressure or vacuum but operation at or near atmospheric pressure is preferred for reasons of economy.

The present invention will now be described with particular reference to the drying of brown coal in an electrical power station environment where the brown coal provides the combustible material which is burned to produce heat which is used to convert water to steam and the steam used to drive turbines which generate electricity. However, it should be understood that the invention is of general applicability where it is necessary to remove a vapourisable material from a solid material. For example, the method of the present invention may be used for drying bituminous coal, iron ore and other mineral ores and for removing solvent from particulate catalyst materials used in industrial processes. Since the fluidizing medium is the vapourisable material, in this case the solvent, the solvent is not contaminated with other fluidizing gases and can be readily recycled for further use.

Also, the invention is of value in processes where brown coal is not used for power generation but for such purposes as hydrogenation for conversion to liquid fuels. In the latter case, the steam derived from the fluidized bed could be recycled and used as a source of hydrogen for the hydrogenation process since it is not contaminated by air or other gases which would render recycling uneconomic.

As mentioned above brown coal as mined contains up to two pounds of water for every pound of dry material. Transportation and handling costs of raw brown coal, on an available energy basis, are thus high and normal commercial practice is to site brown coal consuming power stations on or adjacent to the coal deposits. The coal is then burned in its raw state thereby creating a number of major disadvantages. About 20% of the gross calorific value of the brown coal is used to evaporate the water contained in the coal. The energy is lost as the vapour passes through the system and out of the stack uncondensed. There is a 25% increase in flue gas volume and therefore the size and cost of most of the units through which the flue gas passes are correspondingly increased. Further, the large quantities of water vapour present in the combustion products of the brown coal significantly reduce flame temperature. This leads to a reduction in radiant heat transfer so that radiant tube area has to be increased twofold. Therefore, a boiler of much greater size and cost is thus required to house the additional tubes. Difficulty in fuel ignition and maintenance of flame-stability are two other unsolved problems arising from the use of raw brown coal in boilers.

Typically, a power generation system comprises a boiler in which combustible material such as brown coal is burnt to produce heat energy which is used to convert water to steam under pressure.

The steam is passed through a first high pressure turbine wherein electrical energy is generated and the steam is partially condensed and subject to pressure reduction. In order that the full energy content of the steam is utilized it is usually then passed through one or more subsequent turbines at progressively lower pressures and more electrical energy is generated at each stage until the pressure of the steam is under substantial vacuum. After the first high pressure turbine stage the steam may be reheated by being passed through the boiler so that it regains some of its temperature.

In a power generation system using the present invention some of the steam from a high pressure turbine exhaust may be fed under pressure, prior to reheat, to the heating tubes in the fluidized bed so as to transfer heat to particulate raw brown coal forming the fluidized bed. Preferably, the steam from the high pressure turbine exhaust is desuperheated by condensate injection prior to being fed into the heating tubes of the fluidized bed. Typically, the saturated steam is applied to the dryer tubes at a pressure from atmospheric up to 3200 p.s.i.a. A higher pressure leads to a larger temperature difference between the tubes and the fluidized bed. Where the bed is operated at or near atmospheric pressure it is preferred to apply saturated steam to the dryer tubes at a pressure in the range from 70–300 p.s.i.a. This method ensures a large temperature difference between the heating surface and the fluidized bed so reducing the required heat transfer area in the fluidized bed. The condensate from the dryer tubes may be returned into the steam generation cycle of the power generation system. The temperature difference across the heating tubes may range between 160° C. (for example, a tube temperature of 270° C. at which brown coal gives off volatiles and a bed temperature of 110° C.) and a lower value dependent on the properties of the particulate material. Preferably, the temperature difference ranges from 25°–150° C. more preferably from 40°–110° C. Down to 40 percent by weight moisture brown coal exerts the vapour pressure of liquid water and the bed can be held at 105° C. at atmospheric pressure and drying would continue. Below this moisture content higher bed temperatures such as 110°–120° C. at atmospheric pressure are needed.

The indirect heating of the fluidized bed causes steam to be driven off from the raw brown coal usually at a relatively low pressure typically less than 10 p.s.i.g. such as 5 p.s.i.g. or even atmospheric pressure although the steam could be driven off at high pressure or under vacuum. Providing the residence time of the coal in the bed is sufficient the bulk of the water contained therein, such as 90%, or about 100% if the bed is sufficiently superheated for the particulate material being dried, can be driven off in this way. Where the coal contains initially 66% of water by weight removal of 90% of the water reduces the water content to 16%.

The steam driven off is used as part or all of the fluidizing medium for the fluidized bed and no air is introduced into the fluidized bed. However, the amount of steam produced increases from bottom to top of the bed and thus there may not be sufficient steam generated from the coal in the lower regions of the fluidized bed. Therefore, some carrier steam, such as about an extra 20% of the dryer steam output, is preferably introduced into the bottom of the bed by blower means such as a fan. The carrier steam could be obtained from the exhaust of a lower pressure turbine. Obtaining the carrier steam in this way would have a minimal effect on efficiency. Alternatively the bed could be provided with a contracting and expanding membrane which would pulsate and assist in fluidizing the lower regions of the bed. Carrier steam can also be product vapour which has its pressure raised sufficiently to force it, through the distribution plate and fluidized bed and cyclones by means of a fan.

Where carrier steam is used the requirement for this can be reduced by constructing the dryer in the shape of an inverted triangle or such other shapes as will reduce in plan cross-section from top to bottom. In this case the cross-sectional area at the top of the bed is greater than that at the bottom in order to minimise or eliminate the necessity of carrier steam or vapour. This construction also has the advantage of enabling greater bed depth to be employed.

Where saturated, or only slightly supersaturated vapour is supplied to the fluidized bed, condensation could be a problem. Condensation would permit solids to ball up or become attached to the apparatus at various points creating difficulties in operation. This difficulty may be alleviated by providing that the wall means of the apparatus in contact with the solid material is provided with trace heating means, such as steam or gas channels or electrical elements, to ensure that the wall means is at a temperature above the condensation point. Insulation is preferably applied to the top of the trace heating means to reduce waste of heat.

In cases where the fluidizing medium is a solvent the carrier medium is also the solvent and it is preferred that the solvent have a boiling point in the range from 100° to 300° F.

The steam produced from the dryer is of low grade but its latent heat is available for use at various points in the power generation system. For example, a boiler-fed preheater, which in conventional systems uses turbine bleed steam, may be replaced by one using the steam from the dryer. Also, some or all of the dryer steam may be fed to a steam generator where clean steam is produced which may be then fed into a low pressure turbine to produce further electrical energy. Alternatively, the dryer steam could be used for air pre-heating. Preferably, the dirty steam is passed through a cyclone system to remove the bulk of entrained particles which are preferably returned to the fluidized bed.

The use of the drying method in accordance with the present invention in a power generation system reduces the fuel requirement for generation of each unit of power and enables boilers having considerably reduced size to be used.

The dryer steam condensed in the steam generators may be filtered to remove coal fines leaving a clean water product which will be contaminated only by coal particles which escape the filter. This water product is suitable for further applications such as addition to local stream flow, for domestic use, for municipal water supply or as boiler feed water. The filtered coal fines are returned to the dryer if present in significantly large quantities.

In the present invention the raw brown coal will be typically size reduced prior to drying, usually to 2 cm or less. Preferably, the brown coal is size reduced to from 40 μm to 1000 μm. Brown coal reduced to 500 μm or less will inevitably contain some fines. The presence of fines may improve the fluidity of the fluidized bed but offer a problem in that the fines can escape necessitating capture such as on cyclones. Also, the distribution of particle sizes could lead to some segregation in which large particles settle to the bottom of the bed before being sufficiently heated. Therefore, it is envisaged with some coals that the size reduction may need to be such as to reduce the size of the largest particles to 250–300 μm. Preferably, no more than 20% of the raw coal feed is in the form of particles having a size below 40 μm.

As mentioned above, the method of the present invention is also applicable to drying of lump material having a size range of, for example, 0.3–10 cm such as 2 cm. In this case, the material to be dried is fluidized in a denser material. For example, brown coal can be fluidized in silica-sand under such conditions that the material to be dried can float freely and move around in the fluidized material. The density of the fluidized material is dependent to some extent on the density of the lump material.

It will be noted that there is an overlap between the sizes of particle and lump material. In the size range 0.3–2 cm the solid material can be dried as particulate material or as lump material.

The density of the fluidized material will be less than the density of the same material before fluidization. For example, the fluidized bed density may only be about half the density of the material which is fluidized. In this case, the material which is fluidized has to have a density from 1.25 to 2.75 times the density of the lump material.

It is convenient for the dryer to contain heating tubes arranged in a plurality of vertical rows. The rows are separated by a distance appropriate for the size of lumps to be dried. Thus, the lumps must be able to pass between the rows whilst being sufficiently close for drying to take place.

The mixture of lump material to be dried and fluidized material may flow longitudinally of the tubes from one end to the other. The lump material is dried progressively as it moves along. In this case plug-flow of material to be dried obtains and the dried lumps and fluidized material are removed together from a point in the apparatus.

Alternatively, lump material may be fed continually and relatively uniformly over the whole fluidized bed. In this case the flow is substantially well mixed and dried lumps and fluidizing material may be removed from a number of points. The bed may be cylindrical in shape and in this case the heating tubes may be coils.

The method of the present invention may be adapted for multiple effect drying and/or mechanical vapour recompression which are described in detail in our co-filed Patent Application No. PD 3344 entitled "Fluidized Bed Drying".

The present invention will now be described by way of example with reference to the accompanying drawings, in which.

Figure 1:
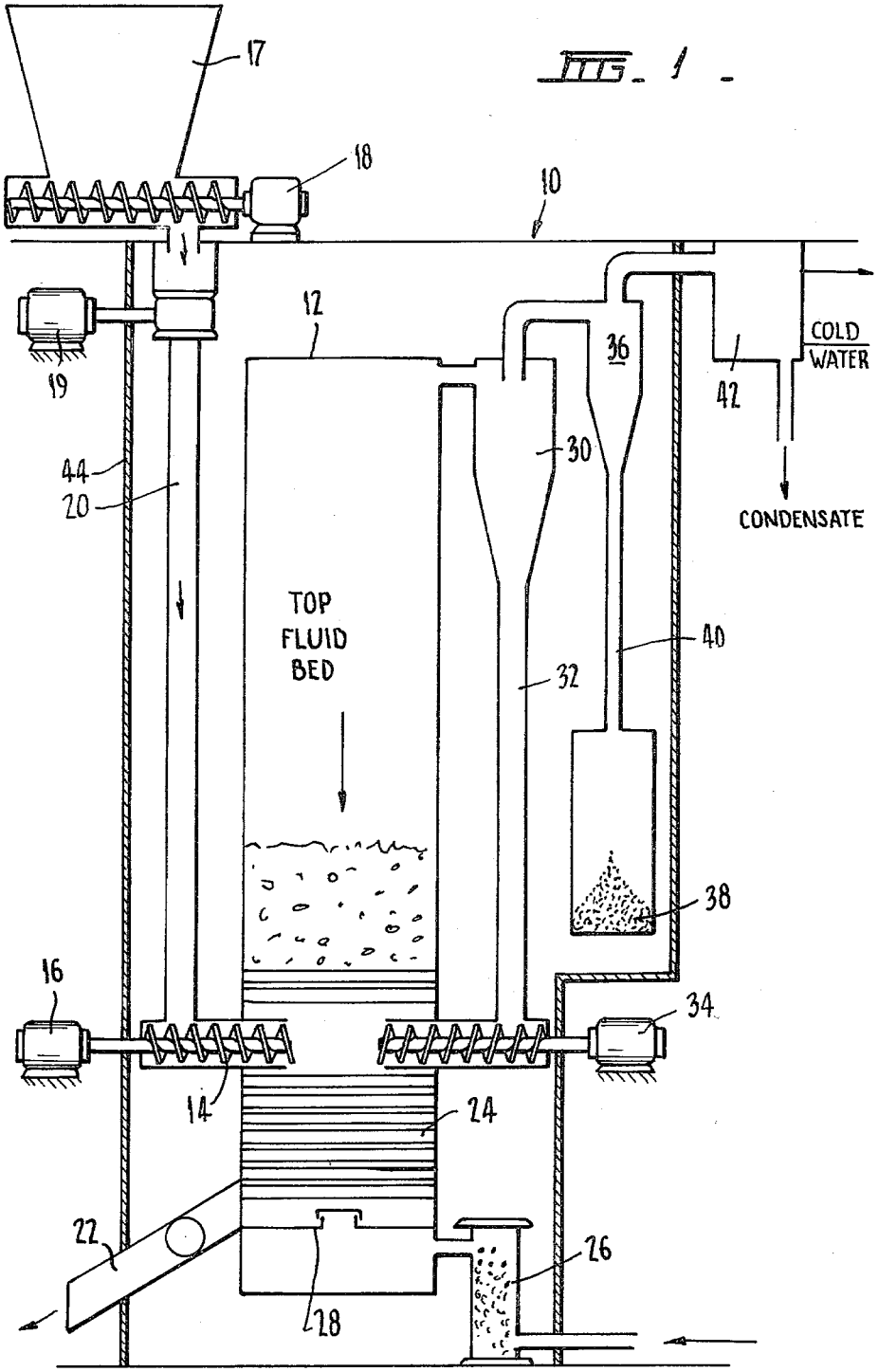
FIG. 1 is a schematic side elevation in section of a pilot plant dryer in accordance with the present invention.

In FIG. 1 there is shown a fluidized bed apparatus 10 comprising a housing 12 having inlet means 14 for particulate brown coal. The coal is passed through the inlet means 14 by means of a screw feed 16. The coal is supplied from a hopper 17 and fed to the screw feed 16 by means of a screw feed 18 at the bottom of the hopper 17 and a rotary feed 19 at the top of a vertical conduit 20 leading from the hopper 17 to the screw feed 16.

Coal is removed continuously in use from the housing 12 at a rate corresponding to the rate of feed by means of a conveyor 22 at the bottom of the fluidized bed.

The housing contains adjacent its lower end a plurality of horizontal parallel spaced tubes 24 which in the pilot plant are electrically heated but which in practice would be steam or hot gas heated as discussed above. The tubes are 1 inch diameter on a 2 inch triangular pitch but any other diameter and appropriate pitch may be employed such as 2 inch tubes on a 6 inch pitch, particularly where carrier steam is used.

Saturated steam is fed through a superheater 26 into the lower end of the housing 12 and thence through a distributor 28.

Dirty steam produced in the housing 12 is fed to a cyclone 30 in which most of the particulate matter contained therein is removed and recycled to the fluidized bed through a conduit 32 and a return feed screw 34. The steam issuing from the cyclone 30 is fed to a further cyclone 36 in which the remainder of the particulate material is removed and deposited in a collection means 38 via a conduit 40. The steam issuing from the further cyclone 36 is condensed in a condenser 42. The drawing illustrates a pilot plant operation which demonstrates the feasibility of the concept of drying by fluidization using indirect heating and using steam as the fluidizing medium. This object is achieved by the illustrated apparatus and thus no attempt is made to reuse the steam in the ways discussed hereinabove. However, it is clear that instead of being merely condensed in condenser 42 the steam could be used for further power generation for mechanical vapour recompression or for multiple effect drying.

The heated portions of the apparatus illustrated in FIG. 1 are enclosed in a thermally insulating jacket 44 although in actual practice each component would then be individually thermally lagged possibly with steam tracer heating inside the lagging to avoid condensation occurring on the inside surfaces of the drying vessel and components.

In use, particulate moist brown coal is fed from the hopper 17 by means of screw feed 18, rotary feed 19, via conduit 20 to screw feed 16. The screw feed 16 feeds the moist coal into the housing 12 in a continuous manner. At the same time the tubes 24 are heated electrically although they could equally well be heated by steam or hot gases as discussed above. The heat transfer from the tubes 24 to the moist coal causes steam to be driven off from the moist coal which steam fluidizes the particles to form a fluidized bed. To assist in fluidization particularly in the lower regions of the bed, as discussed above, some superheated carrier steam is fed through the distributor 28.

Steam is evolved from the bed and rises to the top of the housing 12 from where it passes to the cyclone 30 as discussed above.

At the same time dried coal is removed by conveyor 22 from the bottom of the fluidized bed. The residence time of the coal is so arranged that under the conditions employed a desired amount of moisture such as 90% of the total water content is removed therefrom. A typical residence time is of the order of 50 minutes.

Figure 2:
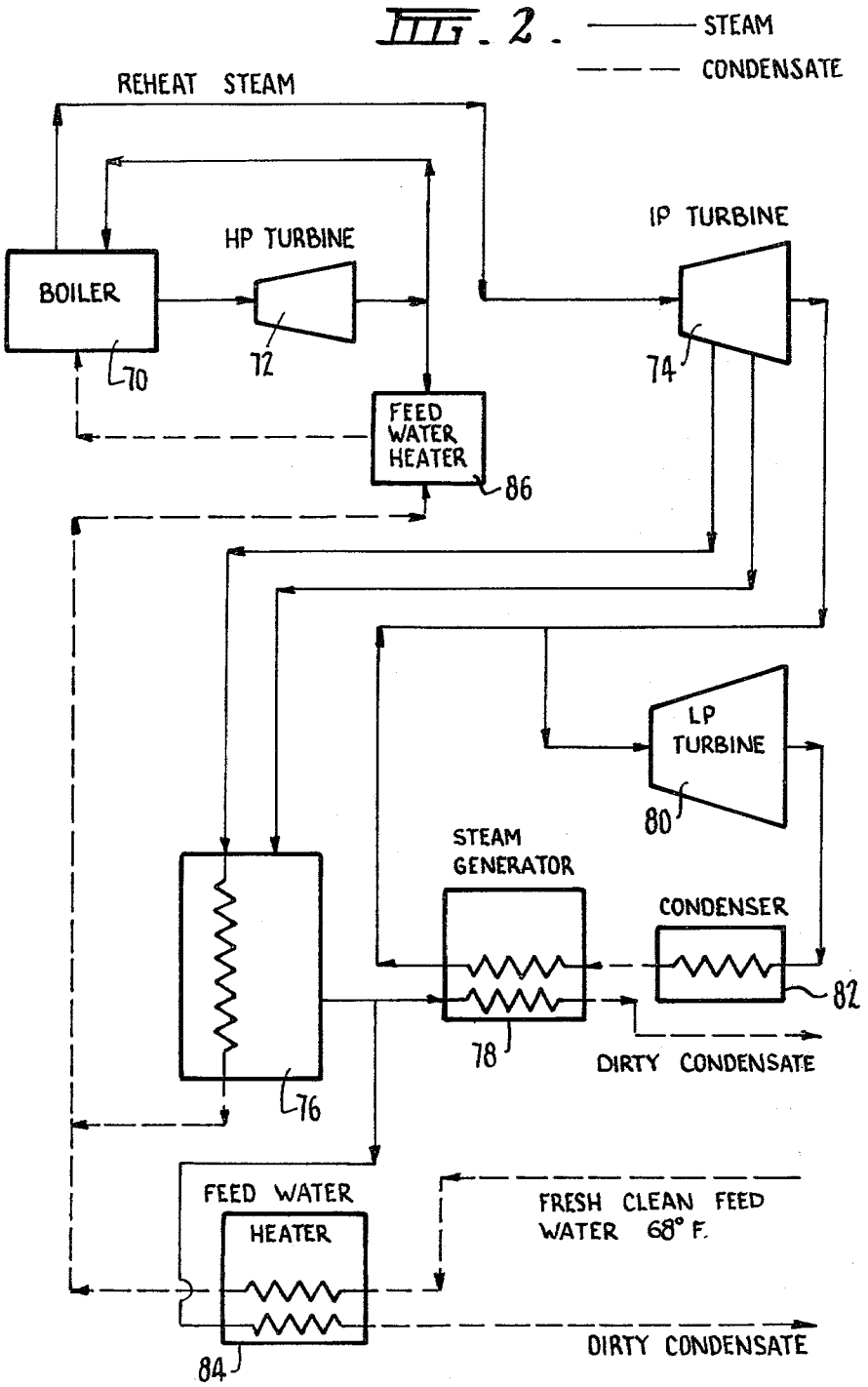
FIG. 2 is a flow diagram illustrating a power generation system incorporating the present invention.

In the flow diagram of FIG. 2 steam is first generated in a boiler 70 by burning of coal. The steam is passed through a high pressure turbine 72 in which electrical energy is produced and the steam loses some of its energy. However, the steam issuing from the high pressure turbine still has sufficient energy to drive an intermediate pressure turbine. Preferably, the steam issuing from the high pressure turbine, which is not employed for some purpose such as feed water heating is returned to the superheat section of the boiler 70 for reheating.

Saturated steam withdrawn from some point in the intermediate pressure turbine 74 is used as a drying medium in a fluidized bed dryer 76 in accordance with the present invention. This steam serves to effect heat transfer to the coal in the dryer 76 by passage through the tubes therein and becoming condensed in the tubes. Further, steam withdrawn from some point in the intermediate pressure turbine 74 at a pressure of about 5 p.s.i.a. in excess of the pressure in the dryer 76 is used as a carrier steam by passage through a distributor in the dryer 76.

The dirty steam from the dryer is fed to a steam generator 78 in which low pressure clean steam is produced. The clean steam may be passed to a low pressure turbine 80 for further power generation from whence it passes through a condenser 82 and is then recycled to the steam generator 78 for reconversion to clean steam.

Alternatively, the dirty steam is passed to a feed water heater 84 to generate heated fresh clean feed water. The feed water from the feed water heater 84 can be passed to a further feed water heater 86 to generate heated feed water for the boiler 70. The dirty condensate from the steam generator 78 may be cleaned such as in a cyclone and/or filter to produce clean water.

Further, the condensate from the dryer tubes can be passed to the feed water heater 86 for reheating prior to being fed to the boiler 70.

The dried coal from the dryer 76 is fed to the boiler 70 where considerable benefits are obtained as discussed above.

The use of the present invention in an electrical power generation system is described in detail in our co-filed Patent Application No. PD 3342 entitled "Power Generation System".

Figure 3:
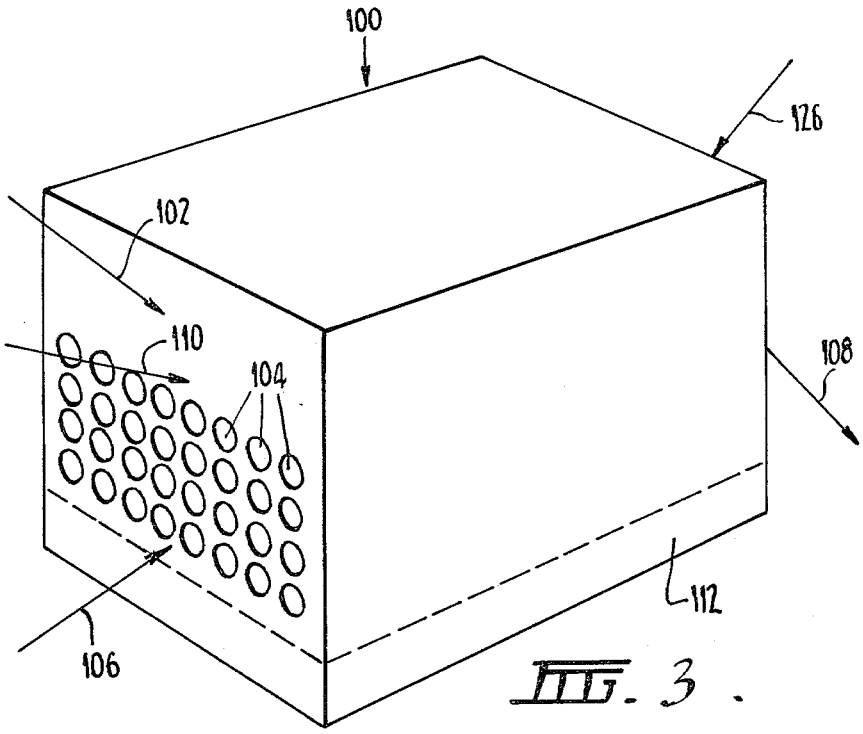
FIG. 3 is a schematic perspective view of a fluidized bed apparatus for drying lump coal.
Figure 4:
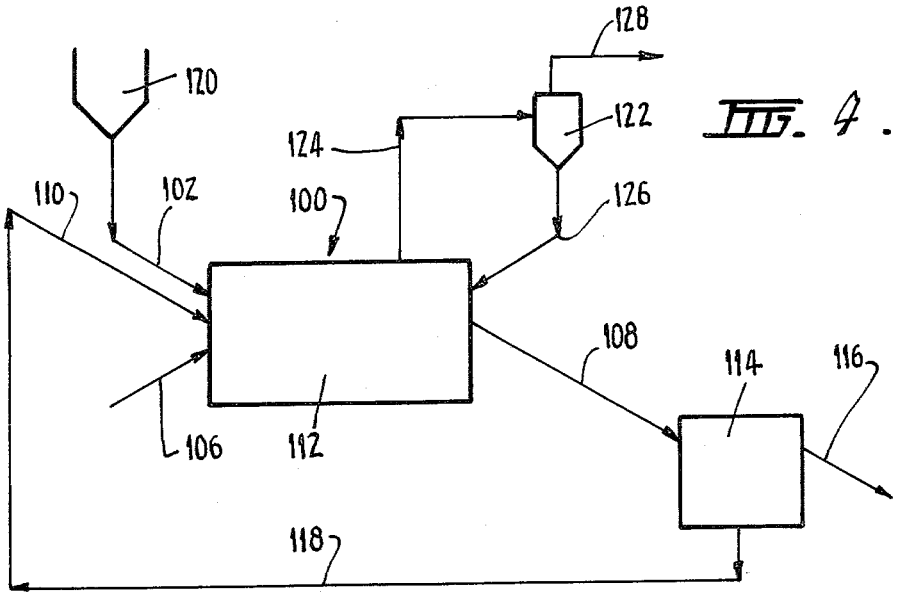
FIG. 4 is a schematic side elevation of a dryer including the fluidized bed of FIG. 3.

In FIGS. 3 and 4 of the drawings there is shown schematically a fluidized bed apparatus 100 comprising lump coal feed means 102. The fluidized bed apparatus 100 contains a plurality of vertical rows 104 of parallel heating tubes which extend from one end of the apparatus 100 to the other. The rows 104 are 4 inches apart to accommodate lumps of about 2 inches in size.

The apparatus 100 is also provided with heating tube steam inlet means 106, removal means 108 for removing dried lump coal and sand return means 110.

As can be seen in FIG. 4, the apparatus 100 also comprises carrier steam inlet means 112. The dryer shown in FIG. 4 also comprises a coal and sand separator 114. The separator 114 comprises a dried coal outlet means 116 and is connected through a line 118 to the sand return means 110. The lump coal feed means 102 is connected to a hopper 120.

Further, the apparatus 100 is connected to a cyclone 122 by a line 124 arranged to remove dirty steam from the fluidized bed. Any solids contained in the dirty steam are removed in the cyclone 122 and returned to the fluidized bed apparatus 100 through a line 126. The steam from the cyclone 122 passes through a line 128 for further use.

In use, lump coal is fed from the hopper 120 through the coal feed means 102 into the fluidized bed which contains fluidized sand. The sand and coal move through the fluidized bed between the rows of tubes 104. At the same time saturated steam is passed through the tubes from the inlet means 106. The saturated steam is condensed in the tubes and transfers its latent heat to the fluidized bed so removing moisture from the coal. Also, some steam, preferably superheated, is passed through the carrier steam inlet means 112 to ensure that the lower regions of the bed are fluidized.

Dirty steam is removed through the line 124 and treated in the cyclone 122 as described above. Sand and coal are removed through removal means 108 and passed to separator 114. The separator 114 may be a sieving device or an elutriating device or any other suitable means for separating lump coal and sand. If the dried material is friable it may be desirable to introduce after or at the end of the dryer a quiescent fluidized bed in which lighter coal particles float to the surface and are removed leaving a virtually coal-free sand to be returned as fluidizing material.

The coal removed from the separator 114 is through outlet means 116 whilst the sand is passed through line 118 to sand return means 110 from where it is used again in the fluidized bed.

Modifications and variations such as would be apparent to a skilled addressee are deemed within the scope of the present invention.

I claim:

1. A method of drying a solid material in lump form containing less than 95% by weight of a vapourisable material which comprises establishing a fluidized bed of a particulate material having a density lying between 1.25 and 2.75 times that of the solid material, introducing fluidizing medium, the fluidizing medium being the varpourisable material in vapour form, feeding the solid material in lump form to be dried to the fluidized bed, heating the fluidized bed indirectly so as to remove vapourisable material from the solid material, removing dried solid material from the bottom of the fluidized bed, and removing a vapour product comprising the vapourisable material substantially uncontaminated by other gases from the fluidized bed for further use.

2. A method as claimed in claim 1, in which the dried solid material is removed in conjunction with a portion of the particulate fluidizing material, the solid material and fluidizing material are separated and the separated fluidizing material recycled to the fluidized bed.

3. In a method of drying a solid material containing less than 95% by weight of a vapourisable material which comprises establishing a fluidized bed containing the solid material, introducing fluidizing medium, heating the fluidized bed indirectly, feeding the material to be dried to the fluidized bed, removing dried solid material therefrom, and removing vapour product from the fluidized bed; the improvement wherein the fluidizing medium is the vapourizable material in vapour form, wherein dried solid material is removed from the bottom of the fluidized bed, and wherein vapour product comprising the vapourisable material substantially uncontaminated by other gases is removed from the fluidized bed for further use.

4. A method according to claim 3, in which the fluidized bed is indirectly heated by using a saturated vapour of the vapourisable material, such that the saturated vapour transfers heat to the fluidized bed and condenses.

5. A method as claimed in claim 4 or 2, in which the fluidized bed is at or near atmospheric pressure.

6. A method as claimed in claim 3, in which the solid material contains less than 75% by weight of vapourisable material.

7. A method as claimed in claim 3, in which the saturated vapour used for indirect heating is at a pressure in the range from 70–300 p.s.i.a.

8. A method as claimed in claim 7, in which the temperature difference between the saturated vapour used for indirect heating and the fluidized bed is in the range from 25°–150° C.

9. A method as claimed in claim 7, in which the temperature difference between the saturated vapour used for indirect heating and the fluidized bed is in the range from 40°–110° C.

10. A method as claimed in claim 3, in which the solid material is in particulate form and in which the solid material constitutes the fluidized bed.

11. A method as claimed in claim 3, in which the solid material is in lump form and the fluidized bed contains a particulate fluidizing material having a density lying between 1.25 and 2.75 times that of the solid material.

12. A method as claimed in claim 3, in which the solid material contains water as the vapourisable material.

13. A method as claimed in claim 12, in which the solid material comprises brown coal.

* * * * *